US006976480B2

(12) United States Patent
Miyoshi et al.

(10) Patent No.: US 6,976,480 B2
(45) Date of Patent: Dec. 20, 2005

(54) EXHAUST GAS RECIRCULATING DEVICE

(75) Inventors: Sotsuo Miyoshi, Tokyo (JP); Hidetoshi Okada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 127 days.

(21) Appl. No.: 10/471,804

(22) PCT Filed: Jan. 16, 2002

(86) PCT No.: PCT/JP02/00245

§ 371 (c)(1),
(2), (4) Date: Sep. 16, 2003

(87) PCT Pub. No.: WO03/060314

PCT Pub. Date: Jul. 24, 2003

(65) Prior Publication Data

US 2004/0107949 A1 Jun. 10, 2004

(51) Int. Cl.[7] ..... F02M 25/07
(52) U.S. Cl. ..... 123/568.12; 123/568.2
(58) Field of Search ..... 123/568.12, 568.2, 123/568.11; 60/605.2, 405.2

(56) References Cited

U.S. PATENT DOCUMENTS

| | | | | |
|---|---|---|---|---|
| 5,617,726 | A * | 4/1997 | Sheridan et al. | 123/568.12 |
| 5,732,688 | A * | 3/1998 | Charlton et al. | 123/568.12 |
| 6,213,105 | B1 | 4/2001 | Banzhaf et al. | |
| 6,367,256 | B1 * | 4/2002 | McKee | 123/568.12 |
| 6,718,956 | B2 * | 4/2004 | Klipfel et al. | 123/568.12 |

FOREIGN PATENT DOCUMENTS

| | | | |
|---|---|---|---|
| DE | 19733964 | A1 | 2/1999 |
| EP | 0987427 | A | 3/2000 |
| EP | 1030050 | A | 8/2000 |
| JP | 08-338321 | A | 12/1996 |
| JP | 11-117815 | A | 4/1999 |
| JP | 11-280565 | A | 10/1999 |
| JP | 2001-041110 | A | 2/2001 |
| JP | 2001-159361 | A | 6/2001 |
| WO | WO 01/44651 | A | 6/2001 |

* cited by examiner

*Primary Examiner*—Willis R. Wolfe, Jr.
(74) *Attorney, Agent, or Firm*—Sughrue Mion, PLLC

(57) ABSTRACT

An exhaust gas recirculation device in accordance with the present invention has an exhaust gas recirculation valve interposed between the exhaust system and the intake system of an internal combustion engine, an exhaust gas recirculation cooler for cooling exhaust gas sent from the exhaust gas recirculation valve to the intake system, and a bypass valve that bypasses the exhaust gas recirculation cooler and sends the exhaust gas to the intake system. The exhaust gas recirculation cooler is put adjacently between the exhaust gas recirculation valve and the bypass valve.

18 Claims, 14 Drawing Sheets

EXHAUST GAS RECIRCULATING DEVICE

TECHNICAL FIELD

The present invention relates to an exhaust gas recirculation (hereinafter referred to as EGR) device that is interposed between the exhaust system and intake system of an engine to reduce nitrogen oxides in the exhaust gas of an internal combustion engine (hereinafter referred to as an engine).

BACKGROUND ART

In general, when fuel is burned in an engine, nitrogen oxides are produced in exhaust gas. An EGR device recirculates the inactive exhaust gas and mixes it with intake air in a combustion chamber of the engine to decrease a combustion temperature, thereby suppressing the amount of product of nitrogen oxides. However, when the amount of exhaust gas is excessive, incomplete combustion is caused and hence the amount of recirculation of exhaust gas is controlled by an EGR valve.

However, the EGR valve is sometimes degraded by exhaust gas of high temperature. Further, since an EGR gas has high temperature and low absorption efficiency, it sometimes reduces an EGR effect. Then, in order to prevent these problems, a structure has been known in which an EGR cooler is mounted on an EGR pipe on the upstream side of the EGR valve. This kind of structure is disclosed in, for example, U.S. Pat. No. 6,213,105.

Embodiment 1 in the Prior Art

FIG. 1 is a perspective view to show the structure of an EGR device of embodiment 1 in the prior art which is disclosed in the above patent gazette. In the drawing, reference numeral 1 denotes an EGR valve. This EGR valve 1 is mainly configured of a housing 1*a*, a distribution chamber 1*b* formed in this housing 1*a*, a connection flange 1*c* that is formed on the housing 1*a* to connect the housing 1*a* to an exhaust pipe (not shown) for guiding exhaust gas which is discharged from the exhaust system of an engine (not shown), and a heat-intercepting flange 1*d* that is formed on the housing 1*a* and intercepts heat transfer between the housing 1*a* and adjusting means which will be described later. Adjusting means 2 for adjusting the opening of EGR valve 1 and an EGR cooler 3 for cooling the exhaust gas passing through the foregoing EGR valve 1 are connected to the housing 1*a* of EGR valve 1 via the heat-intercepting flange 1*d*. A connection plug 4 for supplying electric power is secured to an end portion of the adjusting means 2. The EGR cooler 3 is mainly configured of a bundle of cooling pipes (not shown) through which coolant such as cooling water for cooling the exhaust gas is flowed and a jacket 5 that surrounds the bundle of cooling pipes and flows the exhaust gas through space among the cooling pipes (not shown). A chamber 6 for supplying the coolant to the cooling pipes (not shown) is provided at one end of the EGR cooler 3 and a chamber 7 for recovering the coolant which is discharged from the cooling pipes (not shown) is provided at the other end. A connection part 8 to be connected to coolant supply means (not shown) is fixed to the bottom of chamber 6 and a connection part 9 to be connected to a coolant recovering part (not shown) is fixed to the top of chamber 7. An exhaust gas collecting chamber 10 for collecting the exhaust gas that passes through the EGR cooler 3 while being cooled is fixed to the chamber 7 and provided with a connection flange 11 for connecting exhaust gas collecting chamber 10 to an exhaust gas supply passage (not shown) for supplying the exhaust gas to the intake system of engine (not shown).

Next, an operation will be described.

The exhaust gas which is discharged from the exhaust system of engine (not shown) is supplied to the EGR valve 1 through an exhaust pipe (not shown) and the connection flange 1*c* from the direction shown by arrow A in the drawing. The opening of EGR valve 1 is adjusted by the adjusting means 2 according to a driving condition of the engine (not shown). When the EGR valve 1 is in a closed state, the exhaust gas is not supplied to the intake system of engine (not shown) and when the EGR valve 1 is in an open state, the exhaust gas is discharged from the distribution chamber 1*b* through the EGR cooler 3 to the direction shown by arrow B, whereby it is cooled to a predetermined temperature and returned to the intake system of engine (not shown). Here, the coolant flows into the EGR cooler 3 from the direction shown by arrow C and flows out in the direction shown by arrow D.

Embodiment 2 in the Prior Art

Moreover, in the EGR device, when the exhaust gas is cooled by the EGR cooler in cold weather, warming-up the engine (not shown) over a predetermined temperature is sometimes delayed to impair the functioning of a catalyst and the like. A technology disclosed, for example, in European Patent No. EP 1030050A1 is known as a structure to solve this problem.

FIG. 2 is a front view to show the structure of an EGR device of embodiment 2 in the prior art which is disclosed in the above European Patent gazette. In the drawing, reference numeral 20 denotes an EGR cooler. In the EGR cooler 20 is arranged a coolant pipe (not shown) for passing coolant such as cooling water. Then, a connection part 21 of the coolant pipe (not shown) can be connected to an external coolant supply pipe (not shown) and a connection part 22 can be connected to a coolant discharge pipe (not shown). A pipe 23 for passing the exhaust gas which is discharged from the exhaust system of engine (not shown) is arranged at an end portion on the upstream side of exhaust gas in the EGR cooler 20. Moreover, a bypass pipe 24 is arranged near the pipe 23 between an end portion of the upstream side of exhaust gas and an end portion of the downstream side of exhaust gas in the EGR cooler 20. An upstream opening end 24*a* of bypass pipe 24 and a downstream opening end 23*a* of pipe 23 function as valve seat which is provided at position where they can be alternately opened or closed when one valve body 25 is moved up and down. The valve body 25 is supported by a valve shaft 26 and the valve shaft 26 is slidably supported by a bearing 27 in the opening 20*a* of EGR cooler 20. The top end of valve shaft 26 is fixed to a diaphragm 28, and this diaphragm 28 and a case 29 form a closed space S. Moreover, a valve spring 30 for urging the valve body 25 which is fixed to the diaphragm 28 in the direction shown by arrow E is interposed between the diaphragm 28 and the case 29. Usually, in order to cool the exhaust gas of high temperature, the valve body 25 is pressed onto the upstream opening end 24*a* of bypass pipe 24 by the urging force of valve spring 30. Moreover, a connection part 29*a* for connecting the case 29 to external negative-pressure generating means (not shown) is fixed to the top of case 29.

Next, an operation will be described.

When the exhaust gas which is discharged from the exhaust system of engine (not shown) is higher than a predetermined temperature, the valve body 25 is pressed onto the upstream opening end 24*a* of bypass pipe 24 by the urging force of valve spring 30 to close the opening 24*a* and the exhaust gas is supplied through the downstream opening 23*a* of pipe 23 from the direction shown by arrow A in the drawing to an end portion 20*b* on the upstream side of exhaust gas in the EGR cooler 20. In the EGR cooler 20, the exhaust gas is cooled down to a predetermined temperature by coolant, then discharged from an end portion 20*c* on the downstream side of exhaust gas in the EGR cooler 20 along the direction shown by arrow B, and returned to the intake system of engine (not shown). On the other hand, when the exhaust gas is lower than the predetermined temperature, it does not need to be cooled. For this reason, pressure in the above-mentioned closed space S is reduced through the connection part 29*a* of case 29 by the external negative-pressure generating means (not shown), whereby the diaphragm 28 is deformed upward against the urging force of valve spring 30. At this time, when the diaphragm 28 is deformed, the valve shaft 26 is moved up to press the valve body 25 onto the downstream opening 23*a* of pipe 23, whereby the downstream opening 23*a* is closed. In this manner, the exhaust gas is passed through the end part 20*b* on the upstream side of exhaust gas in the EGR cooler 20 and the bypass pipe 24, discharged along the direction shown by arrow B from the end part 20*c* on the downstream side of exhaust gas in the EGR cooler 20, and returned to the intake system of engine (not shown)

However, in the EGR device of embodiment 1 in the prior art, as shown in FIG. 1, the adjusting means 2 and the EGR cooler 3 are so configured as to be connected to the EGR valve 1, so that it is impossible from a structural viewpoint to connect the bypass pipe 24 of embodiment 2 in the prior art to the EGR valve 1 and hence to return the exhaust gas to the intake system of engine (not shown) without cooling it in cold weather. Thus, there is presented a problem that this EGR device can not solve a trouble of delaying warming up and hence impairing the functioning of a catalyst and the like.

Further, the EGR device of embodiment 2 in the prior art, as shown in FIG. 2 is configured such that an exhaust gas passage is branched between the end portion 20*b* on the upstream side of exhaust gas and the end portion 20*c* on the downstream side of exhaust gas by the bypass pipe 24, so that the bypass pipe 24 is largely expanded outside from the EGR cooler 20. Thus, this presents a problem that this EGR device needs a large space for the bypass pipe 24 and hence cannot save space. Further, a need for separately providing the EGR valve increases the number of connection points and hence increases cost.

Still further, the EGR device of embodiment 2 in the prior art is configured such that the bypass pipe 24 is connected to the branching part of EGR cooler 20. Thus, this presents a problem that the branching part requires a welding work or the like and hence increases manufacturing cost.

Still further, the EGR device of embodiment 2 in the prior art is configured such that the bypass pipe 24 is connected to the branching part of EGR cooler 20. Thus, this produces a temperature difference between the EGR cooler 20 that is cooled and the bypass pipe 24 that is not cooled and hence a large difference in a change in length caused by thermal expansion between them. Therefore, there is presented a problem that stress is applied to the connection part between them and might break them.

The present invention has been made to solve the problems described above. It is the object of the present invention to provide an EGR device that might not be broken by a difference in thermal expansion, hence can be used for a long time, and is manufactured in a compact size and at low cost.

DISCLOSURE OF THE INVENTION

An EGR device in accordance with the present invention has an EGR valve interposed between the exhaust system and the intake system of an internal combustion engine, an EGR cooler for cooling exhaust gas sent from the EGR valve to the intake system, and a bypass valve for switching between a passage that bypasses the EGR cooler and sends the exhaust gas to the intake system and a passage that sends the exhaust gas to the EGR cooler, and the EGR cooler is put adjacently between the EGR valve and the bypass valve. This arrangement eliminates the need for providing a piping for connecting the EGR valve, the EGR cooler, and the bypass valve and hence produces effects of reducing the weight and size of the EGR device and reducing cost because a piping work can be omitted.

In the EGR device in accordance with the present invention, the EGR valve is separately provided with an exhaust gas discharging port for discharging the exhaust gas to the EGR cooler and an exhaust gas discharging port for discharging the exhaust gas to a bypass passage. This arrangement branches an exhaust gas passage within the EGR valve and hence eliminates the need for providing a branching piping outside the EGR valve. Thus, this arrangement produces an effect of omitting the piping work and reducing cost.

In the EGR device in accordance with the present invention, the exhaust gas discharging ports are opened in a direction substantially orthogonal to the axial direction of the EGR valve. With this structure, it is possible to shorten the length of shaft of the EGR valve and hence to produce an effect of reducing load applied to a bearing and ensuring durability of the bearing.

In the EGR device in accordance with the present invention, the EGR valve is connected to the bypass valve with a water cooling piping. This arrangement produces an effect of reducing the weight and size of the EGR device.

In the EGR device in accordance with the present invention, a cooling water passage in the EGR cooler is used as the water cooling piping. This arrangement eliminates the need for providing an external piping and hence produces an effect of reducing the weight and size of the EGR device.

In the EGR device in accordance with the present invention, a connection part by which the EGR valve or the bypass valve is connected to the EGR cooler is formed in the shape of a pipe by die casting. This arrangement produces an effect of reducing the cost of the EGR device.

In the EGR device in accordance with the present invention, a tip portion of an inlet for supplying cooling water into a cooling water passage in the EGR cooler is slanted with respect to the direction of flow of cooling water. With this structure, it is possible to suppress a localized temperature distribution caused by nonuniform circulation of cooling water, hence to uniformly control the temperature in the EGR cooler, and to stabilize an exhaust gas temperature.

The EGR device in accordance with the present invention is characterized in that the direction of flow of cooling water in the EGR cooler is opposite to the direction of flow of exhaust gas. This arrangement produces effects of simplifying the structure of the EGR cooler and reducing cost.

The EGR device in accordance with the present invention is characterized in that the EGR valve is directly connected to the EGR cooler. This arrangement produces effects of expanding the area of passage of exhaust gas and reducing pressure loss in the EGR system.

The EGR device in accordance with the present invention is characterized in that the bypass valve is directly connected to the EGR cooler. This arrangement produces effects of expanding the area of passage of exhaust gas and reducing pressure loss in the EGR system.

The EGR device in accordance with the present invention is characterized in that a bypass pipe that bypasses the EGR cooler and sends the exhaust gas to the intake system of the internal combustion engine is put adjacently between the EGR valve and the bypass valve and arranged parallel to the EGR cooler. This arrangement eliminates the need for providing a piping for connecting the EGR valve, the bypass valve and the bypass pipe. Thus, it is possible to produce effects of reducing the weight and size of the EGR device and reducing cost because the piping work can be omitted.

The EGR device in accordance with the present invention is characterized in that a bellows is provided in at least a part of the bypass pipe. With this structure, it is possible to absorb, by the bellows, a difference in a change in length caused by a difference in a coefficient of thermal expansion between the EGR cooler and the bypass pipe that are different in temperature from each other and hence to suppress unbalanced load applied to the connection part. Therefore, it is possible to produce an effect of preventing the EGR device from being broken.

The EGR device in accordance with the present invention is characterized in that the bypass pipe is configured of a material having a coefficient of thermal expansion smaller than that of the EGR cooler. With this structure, it is possible to absorb a difference in a change in length caused by a difference in a coefficient of thermal expansion between the EGR cooler and the bypass pipe that are different in temperature from each other by a material configuring the bypass pipe and having a small coefficient of thermal expansion and hence to suppress unbalanced load applied to the connection part. Therefore, it is possible to produce an effect of preventing the EGR device from being broken.

The EGR device in accordance with the present invention is characterized in that the actuator of the EGR valve is electrically controlled and that the actuator of the bypass valve is pneumatically controlled. In this manner, an electric control system is used for the actuator requiring to be controlled with high accuracy and a pneumatic control system is used for the actuator for simply switching between passages. Thus, it is possible to produce an effect of reducing the cost of the EGR device keeping high accuracy.

Another EGR device in accordance with the present invention includes an EGR valve interposed between the exhaust system and the intake system of an internal combustion engine, an EGR cooler for cooling exhaust gas sent from the EGR valve to the intake system, and a bypass valve that makes the exhaust gas bypass the EGR cooler to send the exhaust gas to the intake system, and is directly connected to the EGR valve. With this structure, it is possible to expand the area of passage of exhaust gas and hence to reduce pressure loss in an EGR system and to eliminate the need for providing a bypass pipe. Thus, it is possible to produce effects of reducing the weight and size of the EGR device and reducing the cost.

The EGR device in accordance with the present invention is characterized in that a baffle board for obstructing part of a cross section in the EGR cooler. With this structure, it is possible to hinder the cooling water from flowing into the EGR cooler at a dash and to temporarily store the cooling water in the EGR cooler. Therefore, it is possible to produce an effect of ensuring a uniform cooling effect with respect to exhaust gas.

BEST MODE FOR CARRYING OUT THE INVENTION

Hereinafter, in order to describe the present invention in more detail, best modes for carrying out the present invention will be described with reference to the accompanied drawings.

Embodiment 1

Figure 1:
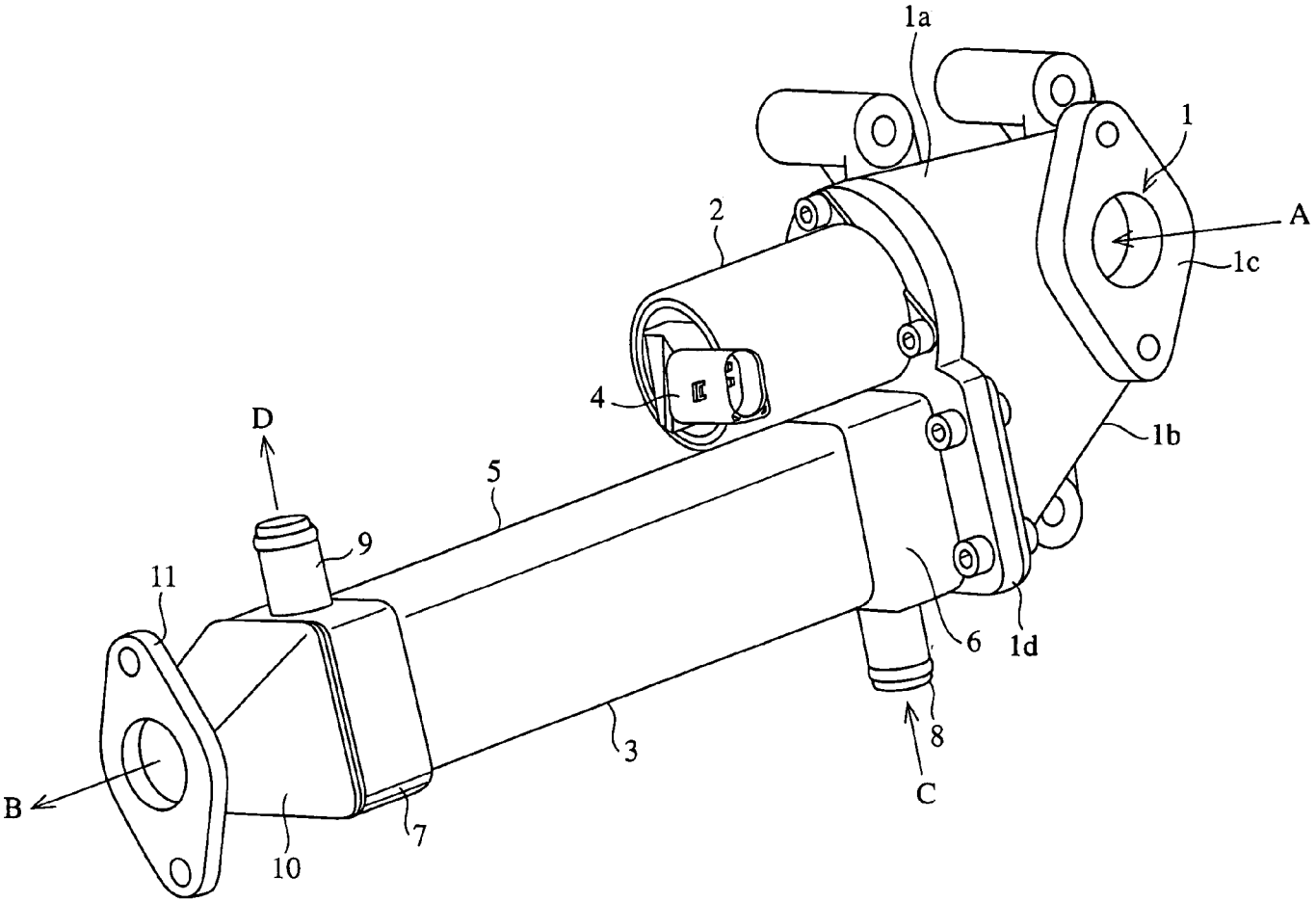
FIG. 1 is a perspective view to show the structure of an EGR device of embodiment 1 in the prior art.
Figure 2:
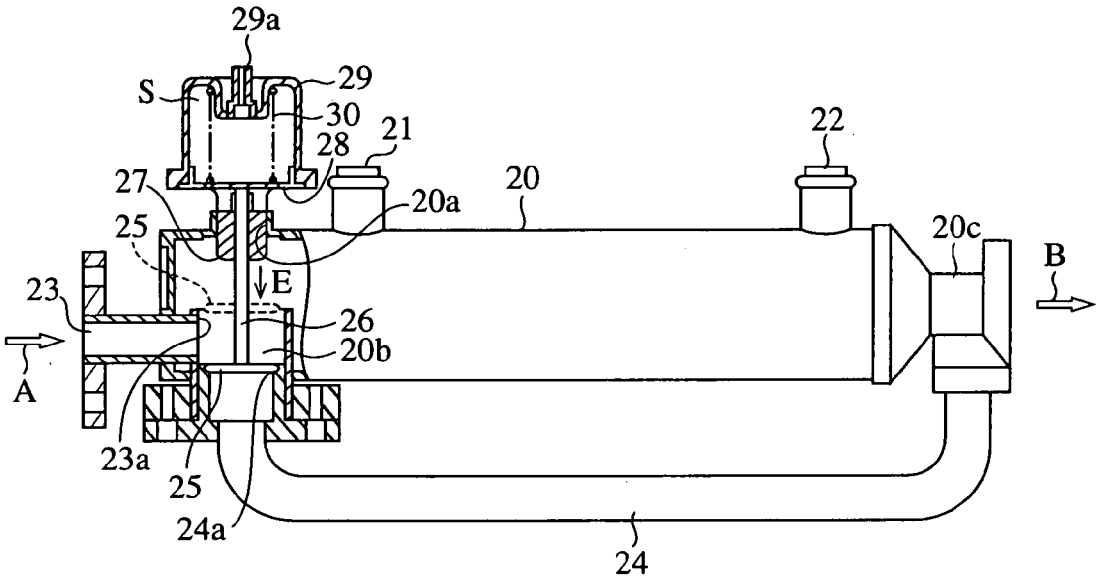
FIG. 2 is a front view to show the structure of the EGR device of embodiment 2 in the prior art.
Figure 3:
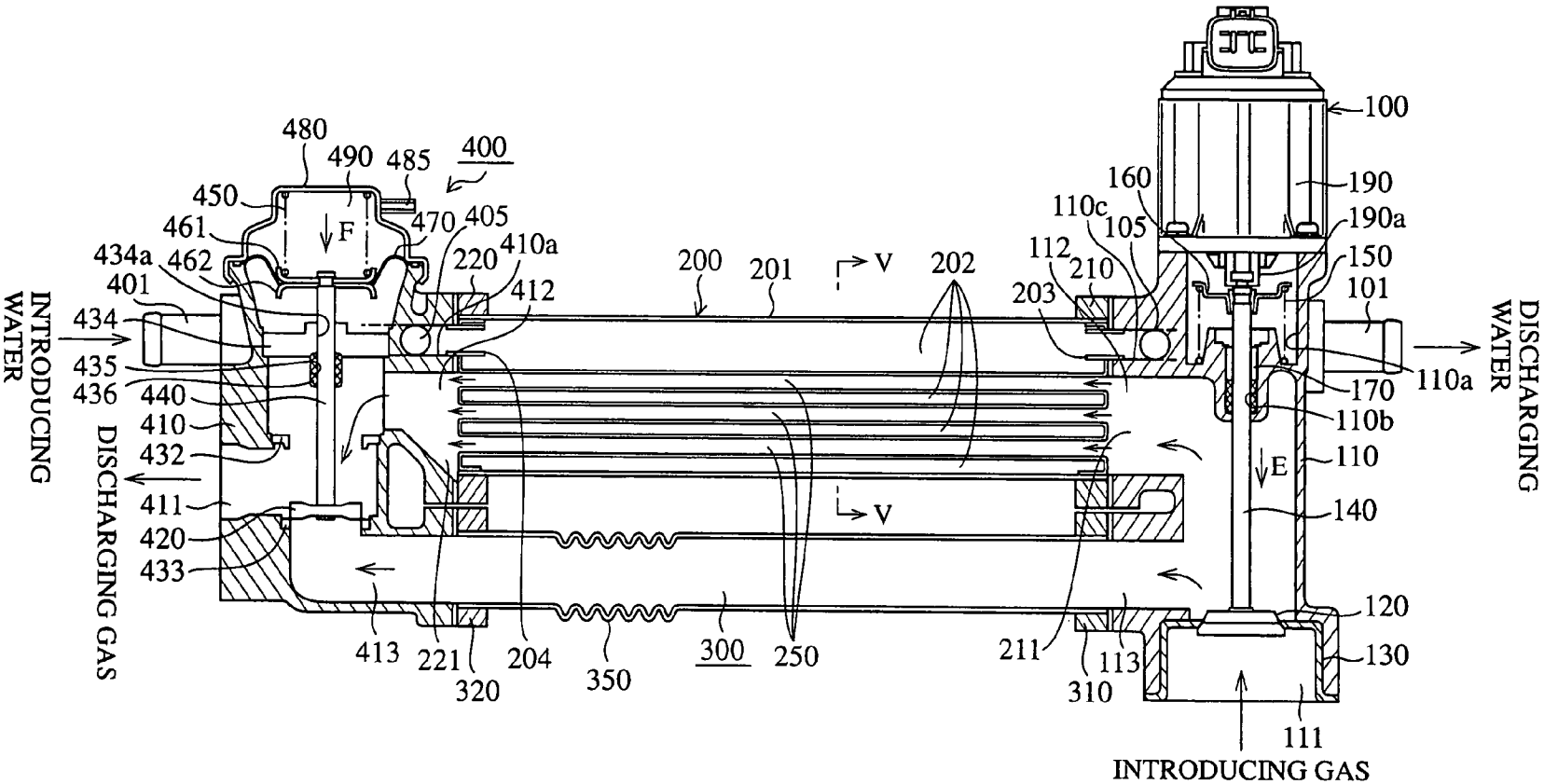
FIG. 3 is a longitudinal sectional view to show the inner structure of the EGR device in accordance with embodiment 1 of the present invention.
Figure 4:
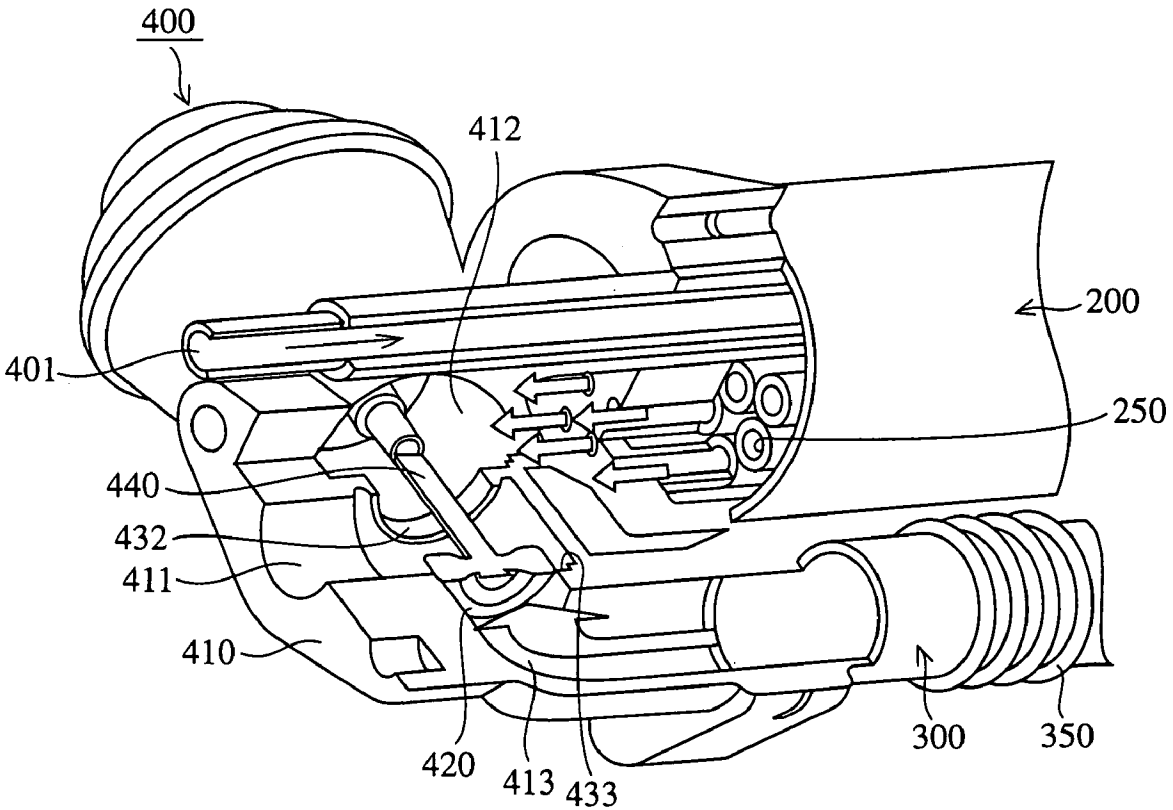
FIG. 4 is a perspective view of relevant part of the EGR device shown in FIG. 3 with parts partially broken away.
Figure 5:
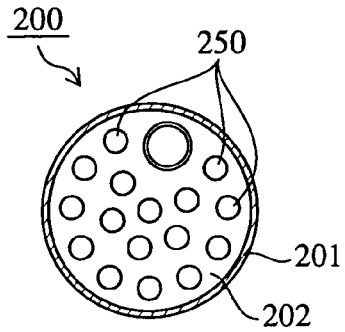
FIG. 5 is a cross sectional view taken on line V—V in FIG. 3.
Figure 6:
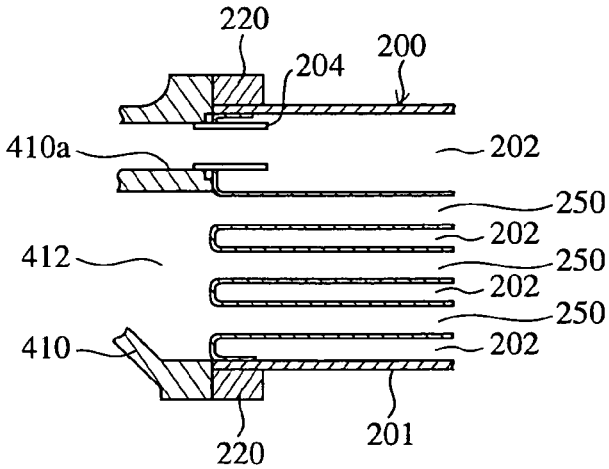
FIG. 6 is a longitudinal sectional view, on an enlarged scale, to show relevant part of the EGR device shown in FIG. 3.

FIG. 3 is a cross sectional view to show the inner structure of an EGR device in accordance with embodiment 1 of the present invention. FIG. 4 is a perspective view of relevant part of the EGR device shown in FIG. 3 with parts partially broken away. FIG. 5 is a cross sectional view taken on line V—V in FIG. 3. FIG. 6 is a longitudinal cross sectional view, on an enlarged scale, to show relevant part of the EGR device shown in FIG. 3. In the drawings, reference numeral 100 denotes an EGR valve, 200 denotes an EGR cooler, 300 denotes a bypass pipe, and 400 denotes a bypass valve.

The EGR valve 100 has a substantially cylindrical housing 110 made of aluminum. A gas introducing port 111 for introducing exhaust gas into the housing 110 is formed in the bottom of housing 110. An exhaust gas discharging port 112 for discharging the exhaust gas into the EGR cooler 200 is formed in the side of housing 110. An exhaust gas discharging port 113 for discharging the exhaust gas into the bypass valve 400 is formed in the side of housing 110 near the exhaust gas discharging port 112. These two exhaust gas discharging ports 112 and 113 are opened toward a direction substantially orthogonal to the axial direction of housing 110. The exhaust gas introducing port 112 for introducing the exhaust gas into the EGR cooler 200 is made as large in area as possible so as to reduce pressure loss caused by connecting the exhaust gas introducing port 112 to the EGR cooler 200. Then, the gas introducing port 111 of housing 110 made of aluminum is provided with a valve seat 130 that is made of stainless steel and prevents the gas introducing port 111 from being corroded by sulfur oxides in the exhaust gas. A depressed portion 110*a* is formed on the top of housing 110 and an opening 110*b* is formed in the center of depressed portion 110*a*. A valve shaft 140 is mounted in the opening 110*b* of housing 110 via a bearing 170 such that it can freely slide in the axial direction. A valve body 120 is fixed to the bottom end of valve shaft 140. The top end of valve shaft 140 abuts against the bottom end of a driving shaft 190 of an actuator 190 and a spring holder 160 is fixed near the top of valve shaft 140. A valve spring 150 for urging the valve body 120 fixed to the valve shaft 140 in the direction that closes a valve (in the direction shown by arrow E) is interposed between the spring holder 160 and the bottom of depressed portion 110*a* of housing 110. The actuator 190 is an electrically controlled (electrically driven) motor for controlling the driving shaft 190*a* in a vertical direction with high accuracy. Further, a cooling water passage 105 for introducing cooling water from the EGR cooler 200 is formed in part of housing 110. By cooling the housing 110 with this cooling water passage 105, the actuator 190 is prevented from being broken by the housing 110 becoming high temperature. Moreover, the housing 110 and inside parts such as the bearing 170 are also cooled by the cooling water passage 105.

The EGR cooler 200 is used for cooling the exhaust gas to a predetermined temperature so as to increase intake efficiency of an engine after warming-up. The EGR cooler 200 is provided with a substantially cylindrical case 201. Inlet/outlet flanges 210 and 220 are fixed to the outer peripheral portions at both ends of the case 201 by mechanical means such as welding. The case 201 is fixed to the side of EGR valve 100 via the inlet/outlet flange 210 and is fixed to the side of bypass valve 400 via the inlet/outlet flange 220. A plurality of exhaust gas passages 250, as shown in FIG. 5, are provided in the case 201. The inlet 211 of exhaust gas passages 250 is made as large in area as possible so as to reduce the pressure loss, as in the case with the exhaust gas discharging port 112 of housing 110 of EGR valve 100 which is opposed to the inlet 211. Portions except for the exhaust gas passages 250 in the case 201 communicate with each other to form a cooling water passage 202 filled with cooling water. A pipe 203, which is connected to the opening 110*c* of housing 110 and communicates with the cooling water passage 105, is fixed to a downstream end portion of cooling water, which is a part of the cooling water passage 202. A pipe 204 that is connected to the opening 410*a* of housing 410 of bypass valve 400 and communicates with a cooling water passage 405 is fixed to an upstream end portion of cooling water in the cooling water passage 202.

The bypass pipe 300 is used for introducing the exhaust gas into the bypass valve 400 in a case where the exhaust gas passing through the EGR valve 100 does not need to be cooled. An inlet/outlet flange 310 is fixed to the outer peripheral portion of an end portion on the upstream side of exhaust gas in the bypass pipe 300 by mechanical means such as welding and the bypass pipe 300 is fixed to the side of EGR valve 100 so as to communicate with the exhaust gas discharging port 113 of housing 110 via the inlet/outlet flange 310. An inlet/outlet flange 320 is fixed, with welding or the like, to the outer peripheral portion of an end portion on the downstream side of exhaust gas in the bypass pipe 300 and the bypass pipe 300 is fixed to the side of bypass valve 400 via the inlet/outlet flange 320. A bellows 350 for absorbing a change in length caused by thermal expansion is formed at part of the bypass pipe 300.

The bypass pipe 400 has a substantially cylindrical housing 410. One exhaust gas discharging port 411 and two exhaust gas introducing ports 412 and 413 are formed in the side of housing 410. The exhaust gas introducing port 412 communicates with an exit 221 of exhaust gas passages 250 of EGR cooler 200 and the exhaust gas introducing port 413 communicates with an end on the downstream side of exhaust gas in the bypass pipe 300. Further, the exhaust gas discharging port 411 communicates with the intake system of engine (not shown). A cooler-side valve seat 432 is fixedly press-fitted in the center of housing 410 and a bypass-side valve seat 433 is fixedly press-fitted in the bottom of housing 410 at a position coaxial with the foregoing cooler-side valve seat 432. Moreover, a support member 434 is provided in an upper portion surrounded by the inner walls of housing 410 and an opening 434*a* is formed in the center of support member (bearing) 434. A valve shaft 440 is disposed in the opening 434*a* of housing 410 via a filter 435 (which is something like a steel wool to scrape adherents of exhaust gas) such that it can freely slide in the axial direction. Moreover, reference numeral 436 denotes a holder that holds the filter 435. A valve body 420 is fixed to the bottom end of valve shaft 440. The top end of valve shaft 440 is fixed to a spring holder 461. The outer peripheral portion of a diaphragm 470 put adjacently between this spring holder 461 and another spring holder 462 is fixed in a state where it is put adjacently between the top end edge of housing 410 and a case 480. The diaphragm 470 and the case 480 configure a pressure chamber 490. A connection part 485 for connecting the case 480 to a solenoid valve (not shown) is fixed to the top of case 480. A valve spring 450 for urging the valve body 420 in the direction that makes the valve body 420 abut against the bypass-side valve seat 433 (in the direction shown by arrow F) is interposed between the spring holder 461 and the case 480. A pipe 401 for introducing cooling water to be supplied to the EGR cooler 200 is fixed to the top of housing 410. The pipe 401 is connected through a cooling water passage 405, the cooling water passage 202 of EGR cooler 200, and the cooling water passage 105 to a pipe 101 fixed to the housing 110 of EGR valve 100. These passages configure one water cooling piping.

Next, an operation will be described.

When the exhaust gas is discharged from the exhaust system of engine (not shown), the driving shaft 190*a* of actuator 190 of EGR valve 100 presses down the valve shaft 140 in the direction shown by arrow E against the urging force of valve spring 150. With this structure, the valve body 120 fixed to the valve shaft 140 is separated from the valve seat 130 to make the gas introducing port 111 communicate with the inside of housing 110, whereby the exhaust gas is introduced into the housing 110.

At this time, in a case where the temperature of exhaust gas is higher than a predetermined temperature, in the bypass valve 400, the pressure chamber 490 does not introduce a negative pressure, so that a state is kept where the valve body 420 is made to abut against the valve seat 433 by the urging force of valve spring 450 and hence the bypass pipe 300 is held closed. Thus, the exhaust gas introduced into the housing 110 of EGR valve 100 does not pass through the bypass pipe 300 but passes through the plurality of exhaust gas passages 250 in the EGR cooler 200 thereby to be cooled to a predetermined temperature and is introduced into the bypass valve 400 through the exhaust gas introducing port 412 and is returned through the exhaust gas discharging port 411 to the intake system of engine (not shown).

Further, in a case where the temperature of exhaust gas is lower than the predetermined temperature, a solenoid valve (not shown) is operated to bring the pressure chamber 490 into negative pressure. At this time, a pressure difference is produced between the upper and lower sides of diaphragm 470 of pressure chamber 490 and when the negative pressure becomes larger than the urging force of valve spring 450, the diaphragm 470 is moved up against the urging force. When the diaphragm 470 is moved up, the valve body 420 fixed to the valve shaft 440 is also moved up, thereby being separated from the bypass-side valve seat 433. When the negative pressure in the pressure chamber 490 is further increased, the valve shaft 440 is moved up to make the vale body 420 abut against the cooler-side valve seat 432. For this reason, the EGR cooler 200 is closed. Thus, the exhaust gas introduced into the housing 110 of EGR valve 100 does not pass through the plurality of exhaust gas passages 250 in the EGR cooler 200 but passes through the bypass pipe 300 and is introduced through the exhaust gas introducing port 412 into the bypass valve 400 and is returned through the exhaust gas discharging port 411 to the intake system of engine (not shown).

As described above, according to this embodiment 1, the EGR device is configured such that the EGR cooler 200 is put adjacently between the EGR valve 100 and the bypass valve 400. Thus, this eliminates the need for providing a piping for connecting the EGR valve 100, the EGR cooler 200, and the bypass valve 400. Therefore, it is possible to produce effects of achieving reduction in weight and size of the EGR device and at the same time reducing cost because a piping work can be omitted.

In this embodiment 1, the EGR device is configured such that the exhaust gas discharging port 112 for discharging the exhaust gas to the EGR cooler 200 and the exhaust gas discharging port 113 for discharging the exhaust gas to the bypass valve 400 are separately formed in the EGR valve 100. Thus, this eliminates the need for mounting a branch pipe to the outside of EGR valve 100 and hence produce effects of omitting the piping work and reducing cost.

In this embodiment 1, the EGR device is configured such that the exhaust gas discharging ports 112 and 113 are opened in the direction substantially orthogonal to the axial direction of EGR valve 100, so that the flange part can be shared by them. Thus, it is possible to produce an effect of simplifying a connection structure (in particular, sealing structure).

In this embodiment 1, the EGR device is configured such that the EGR valve 100 and the bypass valve 400 are connected to each other by one water cooling piping configured of the pipe 401, the cooling water passage 405, the cooling water passage 202, the cooling water passage 105 and the pipe 101. Thus, it is possible to produce an effect of achieving reduction in weight and size of the EGR device.

In this embodiment 1, the EGR device is configured such that the cooling water passage 202 in the EGR cooler 200 is used as the water cooling water piping. Thus, this eliminates the need for providing an outside piping and hence can produce an effect of achieving reduction in weight and size of the EGR device.

In this embodiment 1, the EGR device is configured such that the EGR valve 100 is directly connected to the EGR cooler 200 and that the bypass valve 400 is directly connected to the EGR cooler 200. Thus, this expands the area passage of the exhaust gas and hence produces an effect of reducing pressure loss in the EGR system.

In this embodiment 1, the EGR device is configured such that the bypass pipe 300 for bypassing the EGR cooler 200 and for sending the exhaust gas to the intake system of an internal combustion engine is put adjacently between the EGR valve 100 and the bypass valve 400 and is arranged in parallel to the EGR cooler 200. Thus, this eliminates the need for providing a piping for connecting the EGR valve 100, the bypass valve 400 and the bypass pipe 300 and hence can produce effects of achieving reduction in weight and size of the EGR device and reducing cost because the piping work can be omitted.

In this embodiment 1, the EGR device is configured such that the bellows 350 is mounted on at least a part of the bypass pipe 300. Thus, this can absorb a change in length caused by a difference in a coefficient of thermal expansion between the EGR cooler 200 and the bypass pipe 300 that are different from each other in temperature, to suppress imbalanced load applied to the connection part between them, and hence can produce an effect of preventing the EGR device from being broken. In this embodiment, the EGR device is configured such that the actuator of EGR valve 100 which is required to be controlled with high accuracy is made to be electrically controlled and that the actuator of bypass valve 400 for simply switching passages is pneumatically driven. Thus, it is possible to produce of an effect of reducing the cost of the EGR device keeping high accuracy.

Incidentally, in this embodiment 1, as shown in FIG. 5, the plurality of exhaust gas passages 250 for flowing the exhaust gas are arranged in the case 201 of EGR cooler 200 and the cooling water is flowed into the space except for these exhaust gas passages 250 in the case 201, but it is also recommended that the exhaust gas passages and the water cooling water passage be configured in a reversed relationship. This is the same with the following respective embodiments.

Embodiment 2

Figure 8:
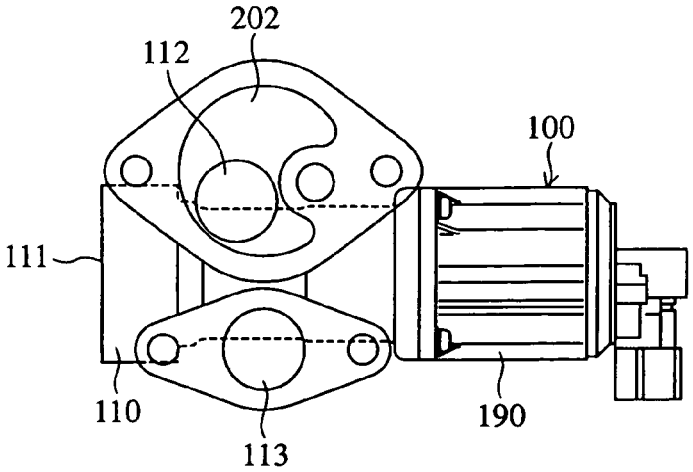
FIG. 8 is a front view to show the structure of piping of the EGR valve used in the EGR device shown in FIG. 7.
Figure 7:
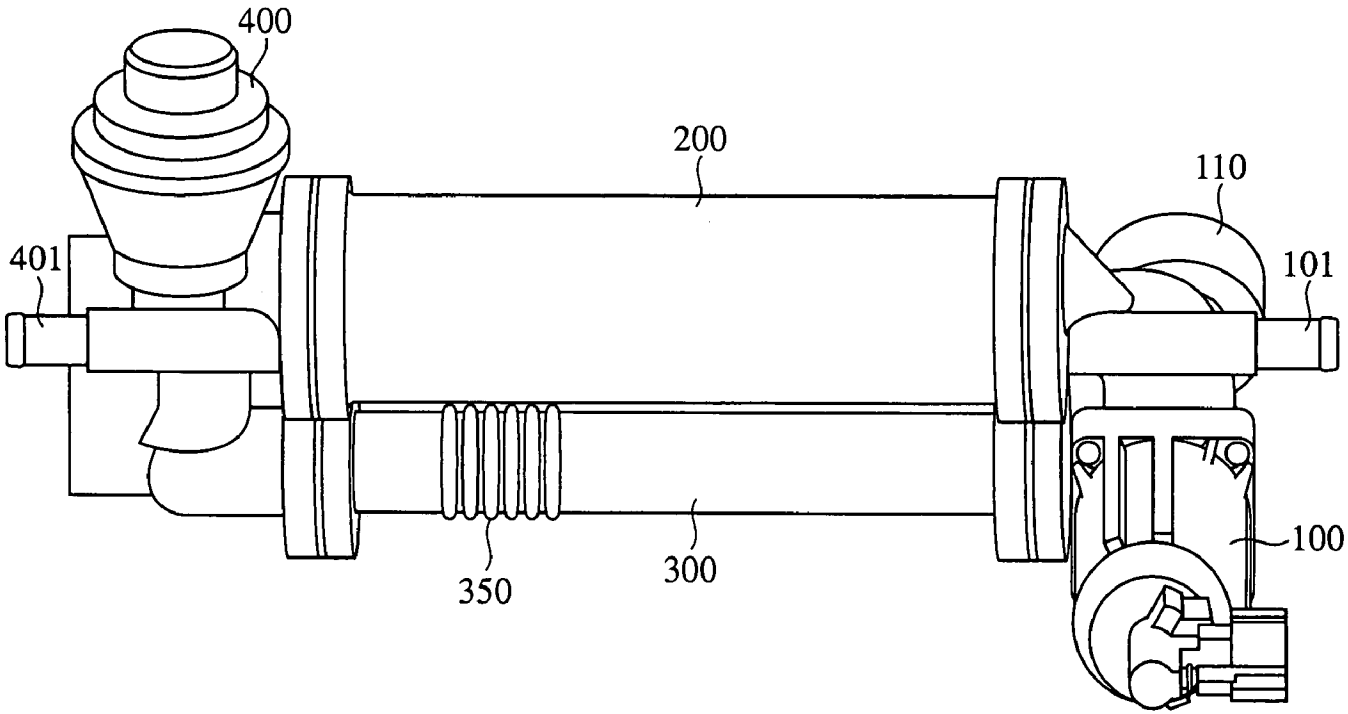
FIG. 7 is a perspective view to show the outer structure of the EGR device in accordance with embodiment 2 of the present invention.
Figure 9:
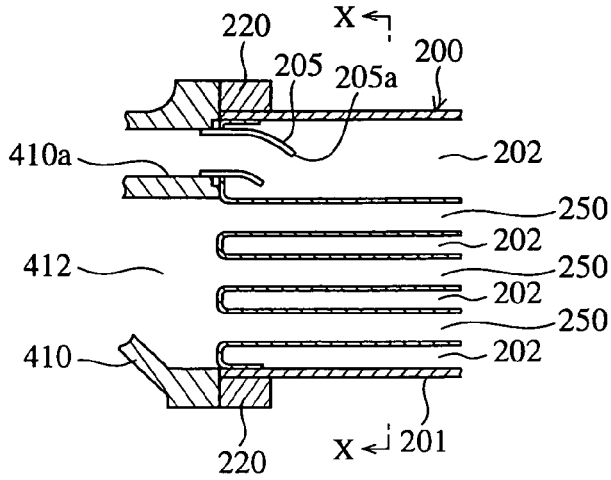
FIG. 9 is a longitudinal sectional view, on an enlarged scale, to show relevant part of the EGR device shown in FIG. 7.
Figure 10:
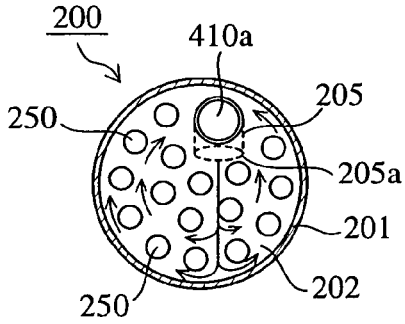
FIG. 10 is a cross sectional view taken on line X—X in FIG. 9.

FIG. 7 is a perspective view to show the outer structure of the EGR device in accordance with embodiment 2 of the present invention. FIG. 8 is a front view to show the structure of piping of the EGR valve used in the EGR device shown in FIG. 7. FIG. 9 is a longitudinal cross sectional view, on an enlarged scale, to show relevant part of the EGR device shown in FIG. 7. FIG. 10 is a cross sectional view taken on line X—X in FIG. 9. Constituent elements of this embodiment 2 that are common to those of the embodiment 1 are denoted by the same reference symbols and their further descriptions will be omitted.

A feature of this embodiment 2 lies in that two exhaust gas discharging ports 112 and 113 which are parallel to each other, as shown in FIG. 7 and FIG. 8, are arranged in a direction orthogonal to the axial direction of EGR valve 100. For this reason, both of the exhaust gas discharging ports 112 and 113 are arranged near the actuator 190, so that the length of a valve shaft (not shown) of EGR valve 100 can be shortened. Shortening the length of the valve shaft in this manner can reduce load applied to a bearing (not shown) as compared with a case where the valve shaft is long, and it produces effects of achieving reduction in weight and size of the EGR valve 100. Moreover, the valve shaft of EGR valve 100, as shown in FIG. 7, is arranged such that it is substantially orthogonal to the valve shaft of bypass valve 400.

Another feature of this embodiment 2 lies in that, as shown in FIG. 9 and FIG. 10, a pipe 205 connected to the opening 410*a* of housing 410 of the bypass valve 400 and communicating with the cooling water passage 405 is fixed to the upstream end portion of cooling water in the cooling water passage 202 and that the downstream end portion 205*a* of this pipe 205 is bent and slanted inwardly in the radial direction of the case 201. Since the downstream end 205*a* of this pipe 205 is directed inwardly in the radial direction of the case 201, cooling water flowing into the cooling water passage 202 from the pipe 205 uniformly goes around in the case 201 as shown by arrows in FIG. 10. With this structure, the exhaust gas in the plurality of exhaust gas passages 250 can be cooled to a predetermined temperature.

As described above, according to this embodiment 2, the EGR valve 100 is configured such that the two exhaust gas discharging ports 112 and 113 which are parallel to each other are arranged in the direction orthogonal to the axial direction of EGR valve 100. Thus, in addition to the effects of the embodiment 1, it is possible to shorten the length of valve shaft of EGR valve 100 and to produce an effect of achieving further reduction in weight and size of the EGR valve 100.

Moreover, in this embodiment 2, the pipe 205 is configured such that its downstream end 205*a* is bent and slanted inwardly in the radial direction of case 201. Thus, it is possible to prevent cooling temperature in the EGR cooler 200 from becoming nonuniform and thus to produce an effect of making an exhaust gas temperature uniform.

In this embodiment 2, the EGR cooler is configured in such a way that the tip potion of an inlet/outlet that supplies cooling water into the cooling water passage 202 in the EGR cooler 200 and discharges cooling water from the cooling water passage 202 is slanted with respect to the direction of flow of cooling water. Thus, it is possible to suppress a localized temperature distribution caused by nonuniform circulation of cooling water and to control temperature in the EGR cooler 200. Therefore, it is possible to produce an effect of stabilizing an exhaust gas temperature.

Embodiment 3

Figure 11:
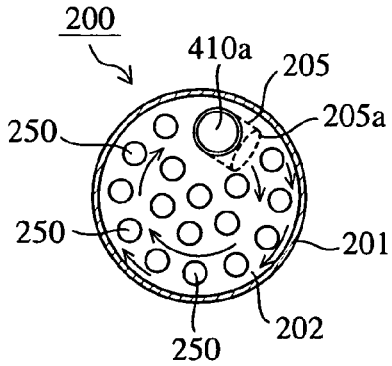
FIG. 11 is a transverse sectional view, on an enlarged scale, to show relevant part of the EGR device in accordance with embodiment 3 of the present invention.

FIG. 11 is a transverse sectional view, on an enlarged scale, to show relevant part of the EGR device in accordance with embodiment 3 of the present invention. Constituent elements of this embodiment 3 that are common to those in the embodiment 1 and 2 are denoted by the same reference symbols and their further descriptions will be omitted.

A feature of this embodiment 3 is different from that of the embodiment 2 and lies in that the downstream end portion 205*a* of this pipe 205 is so configured as to be bent and slanted along the inner peripheral direction of case 201. The cooling water flowing into the cooling water passage 202 from the pipe 205 uniformly goes around in the case 201 as shown by arrows in FIG. 11. With this structure, the exhaust gas in the plurality of exhaust gas passages 250 can be cooled to a predetermined temperature.

As described above, according to this embodiment 3, the pipe 205 is configured such that its downstream end 205*a* is directed toward the inner peripheral direction of case 201. Thus, as is the case with the embodiment 2, it is possible to prevent a cooling temperature in the EGR cooler 200 from becoming nonuniform and hence to produce an effect of making the exhaust gas temperature uniform.

Embodiment 4

Figure 12:
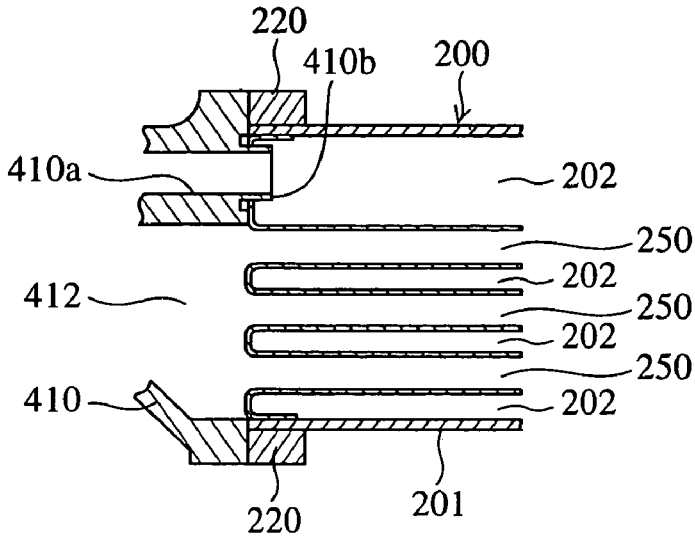
FIG. 12 is a longitudinal sectional view, on an enlarged scale, to show relevant part of the EGR device in accordance with embodiment 4 of the present invention.

FIG. 12 is a longitudinal sectional view, on an enlarged scale, to show relevant part of the EGR device in accordance with embodiment 4 of the present invention. Constituent elements of this embodiment 4 that are common to those of the embodiment 1 and the like are denoted by the same reference symbols and their further descriptions will be omitted.

A feature of this embodiment 4 lies in that the connection part 410*b* of bypass valve 400 connected to the upstream end of cooling water passage 202 in the EGR cooler 200 is integrally formed with the housing 410 of bypass valve 400 by die casting to eliminate the pipe 204 in the embodiment 1 or the pipe 205 in the embodiment 2 and embodiment 3.

As described above, according to this embodiment 4, the bypass valve 400 is configured such that its connection part 410*b* is integrally formed with the housing 410 of bypass valve 400. Thus, it is possible to eliminate part of the pipe 204 or 205 and hence to produce an effect of reducing the cost of the EGR device.

Embodiment 5

Figure 13:
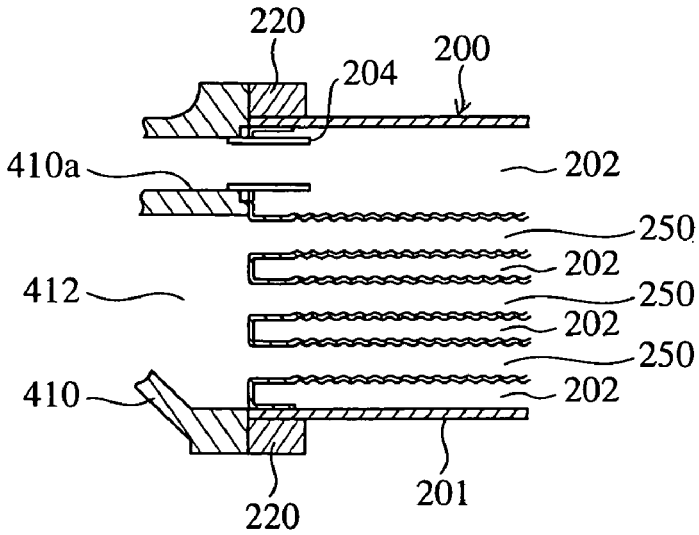
FIG. 13 is a longitudinal sectional view, on an enlarged scale, to show relevant part of the EGR device in accordance with embodiment 5 of the present invention.

FIG. 13 is a longitudinal sectional view, on an enlarged scale, to show relevant part of the EGR device in accordance with embodiment 5 of the present invention. Constituent elements of this embodiment 5 that are common to those of the embodiment 1 and the like are denoted by the same reference symbols and their further descriptions will be omitted.

A feature of this embodiment 5 lies in that the periphery of cooling water passage 202 of EGR cooler 200 is formed in a wavy shape in cross section.

As described above, according to this embodiment 5, the EGR cooler 200 is configured such that the periphery of its cooling water passage 202 is formed in the wavy shape in cross section. Thus, it is possible to increase the surface area of cooling water passage 202 and hence to produce an effect of increasing cooling efficiency with respect to the exhaust gas.

Embodiment 6

Figure 14:
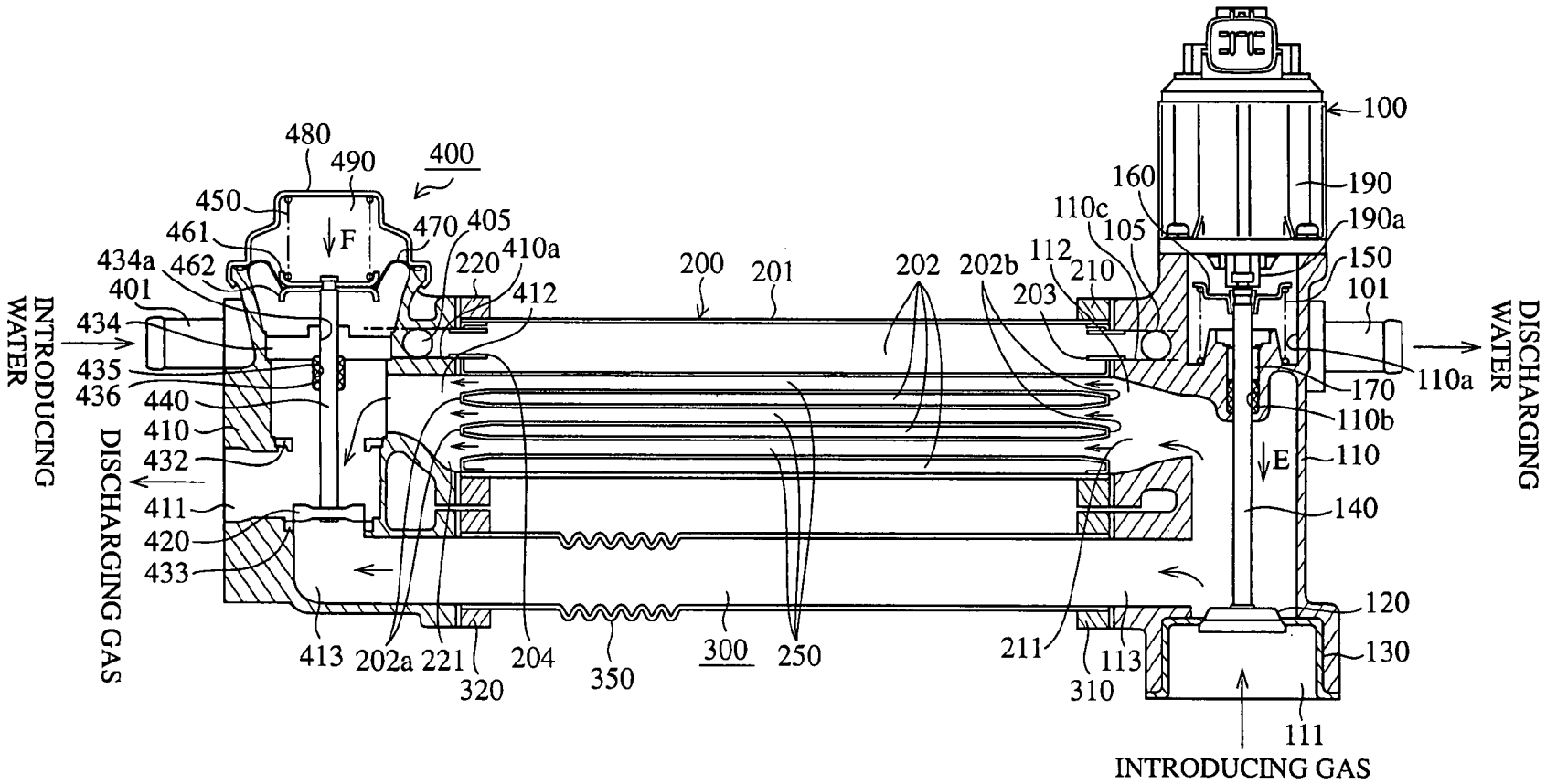
FIG. 14 is a longitudinal sectional view to show the inner structure of the EGR device in accordance with embodiment 6 of the present invention.

FIG. 14 is a longitudinal sectional view to show the inner structure of the EGR device in accordance with embodiment 6 of the present invention. Constituent elements of this embodiment 6 that are common to those of the embodiment 1 and the like are denoted by the same reference symbols and their further descriptions will be omitted.

A feature of this embodiment 6 lies in that the EGR cooler 200 is configured such that both of the upstream end 202*a* and the downstream end 202*b* of its cooling water passage 202 are formed in a shape that tapers toward its tip. Thus, it is possible to reduce passage resistance in the EGR cooler 200 and hence reduce also the pressure loss of the exhaust gas flowing into the EGR cooler 200.

Further, another feature of the embodiment 6 lies in that the bypass pipe 300 is configured of a material having a coefficient of thermal expansion smaller than that of the EGR cooler 200. With this structure, it is possible to absorb a difference in a change in length caused by a difference in a coefficient of thermal expansion between the EGR cooler 200 and the bypass pipe 300, which are different from each other in temperature, by a material that configures the bypass pipe 300 and has a small coefficient of thermal expansion and to suppress nonuniform load applied to the connection part. Thus, this can produce an effect of preventing the EGR device from being broken. Here, in this embodiment 6, the bellows 350 for absorbing a change in length is mounted on part of the bypass pipe 300 configured of the material having the small coefficient of thermal expansion and hence it is possible to obtain a synergistic effect produced by both of the material having the small coefficient of thermal expansion and the bellows 350. Moreover, needless to say, it is also recommendable to employ a structure in which the bellows 350 for absorbing the above-mentioned change in length is not mounted on part of the bypass pipe 300 configured of the material having the small coefficient of thermal expansion.

Embodiment 7

Figure 15:
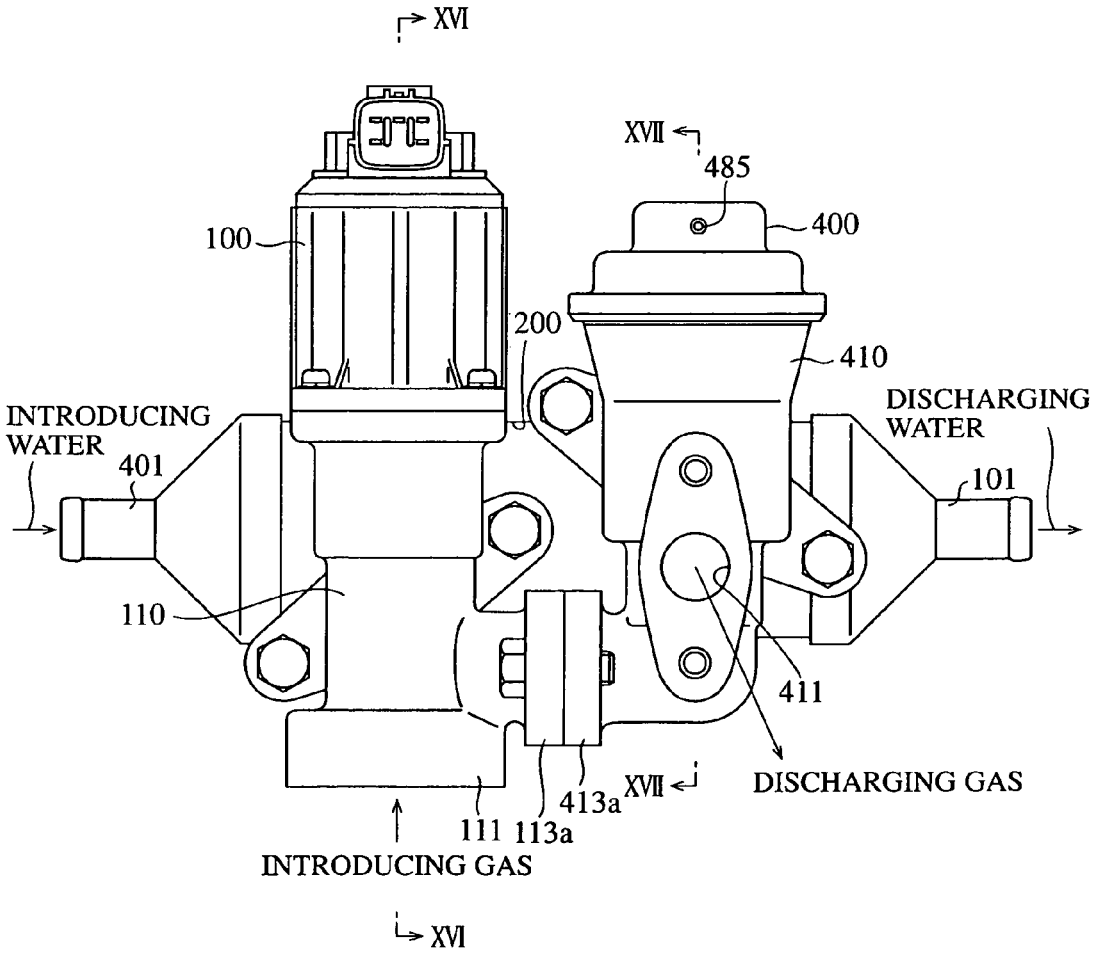
FIG. 15 is a longitudinal sectional view to show the outer structure of the EGR device in accordance with embodiment 7 of the present invention.
Figure 16:
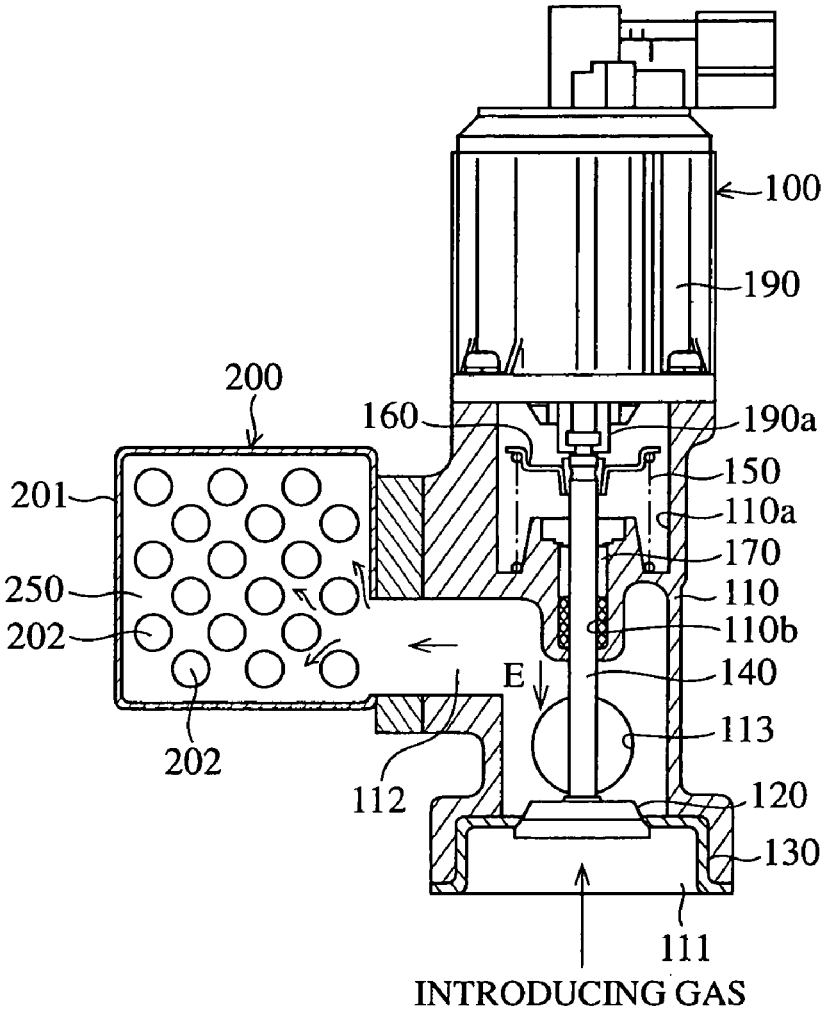
FIG. 16 is a cross sectional view taken on line XVI—XVI in FIG. 15.
Figure 17:
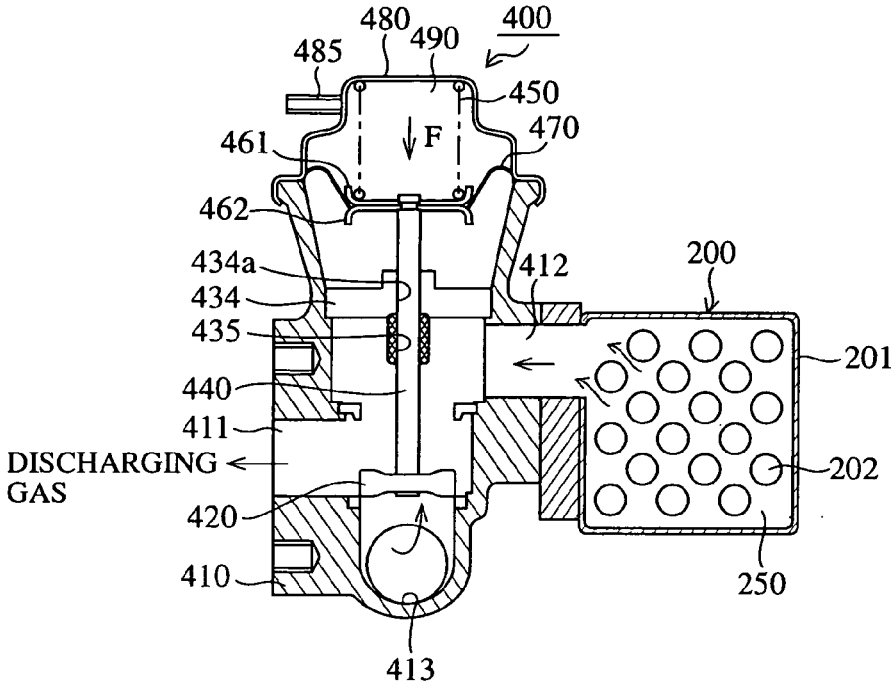
FIG. 17 is a cross sectional view taken on line XVII—XVII in FIG. 15.

FIG. 15 is a longitudinal sectional view to show the outer structure of the EGR device in accordance with embodiment 7 of the present invention. FIG. 16 is a sectional view taken on line XVI—XVI in FIG. 15. FIG. 17 is a longitudinal sectional view taken on line XVII—XVII in FIG. 15. Constituent elements of this embodiment 7 that are common to those of the embodiment 1 and the like are denoted by the same reference symbols and their further descriptions will be omitted.

A feature of this embodiment 7 lies in that the bypass valve 400 is directly connected to the EGR valve 100. That is to say, the EGR valve 100 is mounted on the side on the upstream side of exhaust gas in the EGR cooler 200 and the bypass valve 400 is mounted on the same side on the downstream side of exhaust gas in the EGR cooler 200. A flange 113*a* is provided on the edge portion of exhaust gas discharging port 113 of EGR valve 100 and a flange 413*a* is provided on the edge portion of exhaust gas introducing port 413 of bypass valve 400. The exhaust gas discharging port 113 of EGR valve 100 and the exhaust gas introducing port 413 of bypass valve 400 are so configured as to be made to communicate with each other by fastening the flange 113*a* to the flange 413*a* with bolts. Moreover, the direction of flow of the cooling water in the EGR cooler 200 is set in such a way as to be opposite to the direction of flow of exhaust gas. With this structure, it is possible to cool the exhaust gas of high temperature with the cooling water of low temperature and hence to improve heat exchange efficiency. Here, the EGR cooler 200 is formed in a rectangular cross section.

As described above, according to this embodiment 7, the EGR device is configured such that the bypass valve 400 is directly connected to the EGR valve 100. Hence, it is possible to enlarge the area of the exhaust gas passage and to reduce pressure loss in the EGR system. Further, since the bypass pipe 300 in the embodiment 1 to the embodiment 6 is not required to be provided, it is possible to produce effects of achieving reduction in weight and size of the EGR device and reducing cost.

Further, in this embodiment 7, the EGR cooler 200 is configured such that the direction of flow of the cooling water is opposite to the direction of flow of the exhaust gas. Thus, it is possible to produce effects of simplifying the structure of EGR cooler 200 and reducing cost.

Embodiment 8

Figure 19:
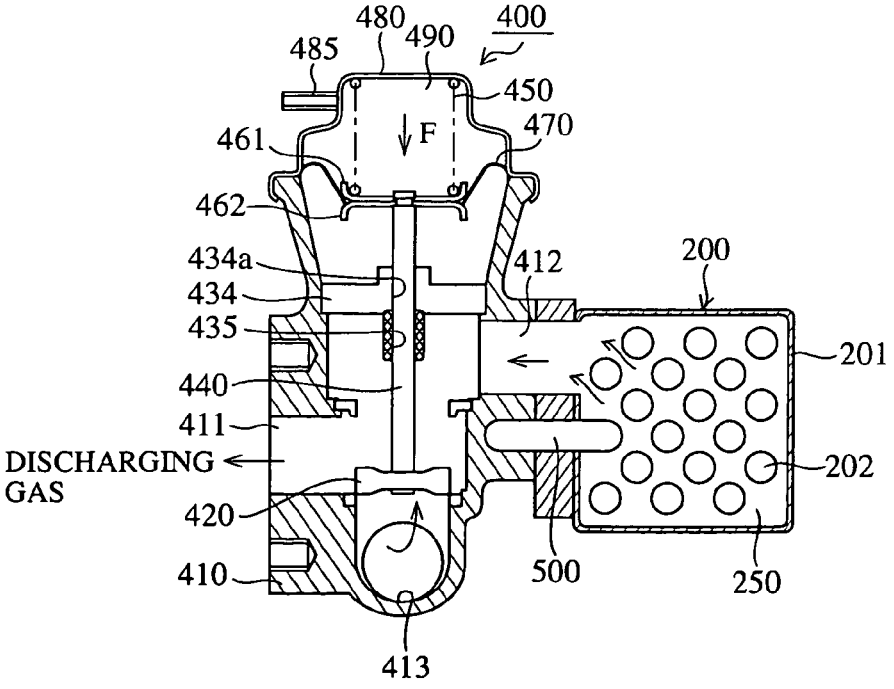
FIG. 19 is a longitudinal sectional view to show the inner structure of another relevant part of the EGR device shown in FIG. 18.
Figure 18:
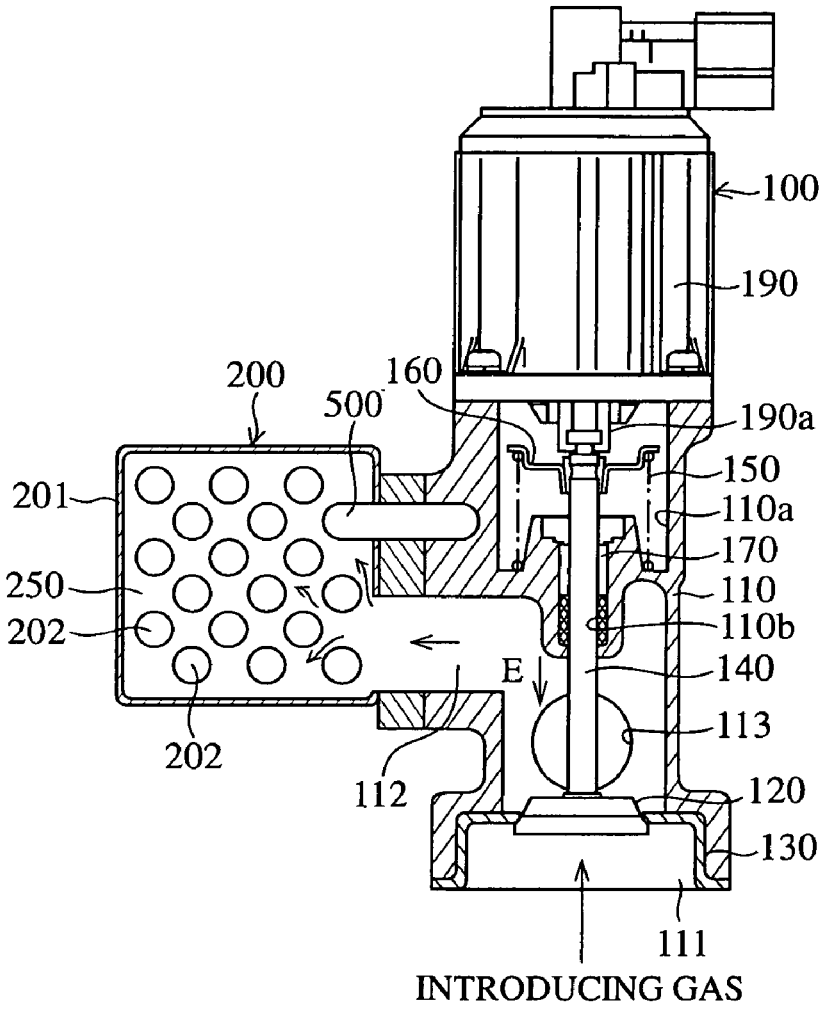
FIG. 18 is a longitudinal sectional view to show the inner structure of a relevant part of the EGR device in accordance with embodiment 8 of the present invention.

FIG. 18 is a longitudinal sectional view to show the inner structure of a relevant part of the EGR device in accordance with embodiment 8 of the present invention. FIG. 19 is a longitudinal sectional view to show the inner structure of another relevant part of the EGR device shown in FIG. 18. Constituent elements of this embodiment 8 that are common to those of the embodiment 1 and the like are denoted by the same reference symbols and their further descriptions will be omitted.

The feature of this embodiment 8 is different from that of the embodiment 7 and lies in that a common cooling water passage 500 is provided in the housing 110 of EGR valve 100 and the housing 410 of bypass valve 400. As described above, according to this embodiment 8, there is provided the common cooling water passage 500. Thus, it is possible to produce effects of efficiently cool the EGR valve 100 and the bypass valve 400 and preventing the spring characteristics of valve spring 150 of EGR valve 100 and the valve spring 450 of bypass valve 400 from being degraded. Further, the motor and the other inside parts can be also cooled.

Embodiment 9

Figure 20:
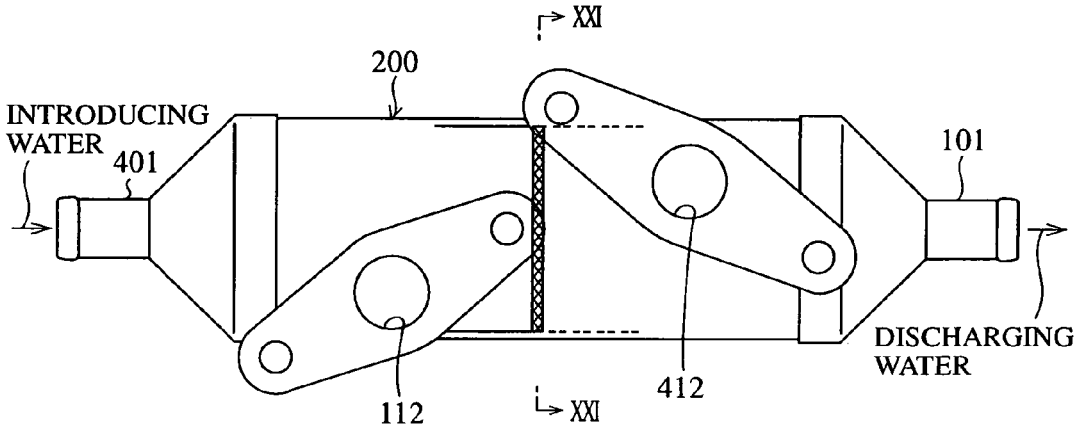
FIG. 20 is a front view to show the outer structure of relevant part of the EGR device in accordance with embodiment 9 of the present invention.
Figure 21:
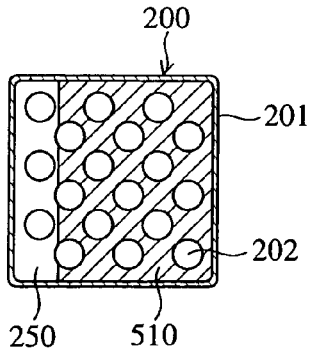
FIG. 21 is a cross sectional view taken on line XXI—XXI in FIG. 20.

FIG. 20 is a front view to show the outer structure of relevant part of the EGR device in accordance with embodiment 9 of the present invention. FIG. 21 is a cross sectional view taken on line XXI—XXI in FIG. 20. Constituent elements of this embodiment 9 that are common to those of the embodiment 1 and the like are denoted by the same reference symbols and their further descriptions will be omitted.

The feature of this embodiment 9 lies in that there is provided a baffle board 510 for obstructing part of a cross section in the case 201 of EGR cooler 200 which is used in the embodiment 7 or the embodiment 8. That is to say, a rectangular baffle board 510 the one side of which is as long as one side of an inside cross section of case 201 and the other side of which is shorter than the other side of the inside cross section of case 201 is arranged in the case 201 which is rectangular in cross section. By this arrangement the cooling water collides with the baffle board 510 on the upstream side in the case 201, goes over a gap between the baffle board 510 and the case 201 while changing the direction of flow, and flows downstream into the case 201.

As described above, according to this embodiment 9, the baffle board 510 is provided in the EGR cooler 200. Thus, this hinders the exhaust gas from flowing through the exhaust gas passage 250 in the EGR cooler 200 at a dash, which results in making the exhaust gas go around in the EGR cooler 200 and producing an effect of making a cooling effect uniform with respect to the exhaust gas.

INDUSTRIAL APPLICABILITY

The present invention relates to a compact EGR device that can be used for a long time and be manufactured at low cost. For this reason, this EGR device can be mounted on the engine of various kinds of automobiles manufactured with a view to reducing cost and size.

What is claimed is:

1. An exhaust gas recirculation device comprising:

an exhaust gas recirculation valve interposed between an exhaust system and an intake system of an internal combustion engine;

an exhaust gas recirculation cooler for cooling exhaust gas sent from the exhaust gas recirculation valve to the intake system; and a bypass valve that bypasses the exhaust gas recirculation cooler, sends the exhaust gas to the intake system, and is directly connected to the exhaust gas recirculation valve.

2. The exhaust gas recirculation device as claimed in claim 1, wherein a baffle board for obstructing part of a cross section in the exhaust gas recirculation cooler.

3. An exhaust gas recirculation device comprising:

an exhaust gas recirculation valve interposed between an exhaust system and an intake system of an internal combustion engine;

an exhaust gas recirculation cooler for cooling exhaust gas sent from the exhaust gas recirculation valve to the intake system; and a bypass valve for switching between a passage that bypasses the exhaust gas recirculation cooler and sends the exhaust gas to the intake system and a passage that sends the exhaust gas to the exhaust gas recirculation cooler, wherein the exhaust gas recirculation cooler is put adjacently between the exhaust gas recirculation valve and the bypass valve.

4. The exhaust gas recirculation device as claimed in claim 3, wherein a tip portion of an inlet for supplying cooling water into a cooling water passage in the exhaust gas recirculation cooler is slanted with respect to a direction of flow of the cooling water.

5. The exhaust gas recirculation device as claimed in claim 3, wherein a direction of flow of cooling water in the exhaust gas recirculation cooler is opposite to a direction of flow of the exhaust gas.

6. The exhaust gas recirculation device as claimed in claim 3, wherein a bellows is provided on at least a part of the bypass pipe.

7. The exhaust gas recirculation device as claimed in claim 3, wherein an actuator of the exhaust gas recirculation valve is electrically controlled and an actuator of the bypass valve is pneumatically controlled.

8. The exhaust gas recirculation device as claimed in claim 3, wherein the exhaust gas recirculation valve is connected to the bypass valve with a water cooling piping.

9. The exhaust gas recirculation device as claimed in claim 8, wherein the water cooling piping is a cooling water passage in the exhaust gas recirculation cooler.

10. The exhaust gas recirculation device as claimed in claim 9, wherein a connection part by which the exhaust gas recirculation valve or the bypass valve is connected to the exhaust gas recirculation cooler is formed in a shape of a pipe by die casting.

11. The exhaust gas recirculation device as claimed in claim 3, wherein the exhaust gas recirculation valve is separately provided with an exhaust gas discharging port for discharging the exhaust gas to the exhaust gas recirculation cooler and an exhaust gas discharging port for discharging the exhaust gas to a bypass passage.

12. The exhaust gas recirculation device as claimed in claim 11, wherein the exhaust gas discharging ports are opened in a direction substantially orthogonal to an axial direction of the exhaust gas recirculation valve.

13. The exhaust gas recirculation device as claimed in claim 11, wherein a bypass pipe that bypasses the exhaust gas recirculation cooler and sends the exhaust gas to the intake system of the internal combustion engine is put adjacently between the exhaust gas recirculation valve and the bypass valve and arranged parallel to the exhaust gas recirculation cooler.

14. The exhaust gas recirculation device as claimed in claim 13, wherein the bypass pipe is configured of a material having a coefficient of thermal expansion smaller than that of the exhaust gas recirculation cooler.

15. The exhaust gas recirculation device as claimed in claim 3, wherein the exhaust gas recirculation valve is directly connected to the exhaust gas recirculation cooler.

16. The exhaust gas recirculation device as claimed in claim 15, wherein the bypass valve is directly connected to the exhaust gas recirculation cooler.

17. The exhaust gas recirculation device as claimed in claim 15, wherein the exhaust gas recirculation valve comprises a first housing, the exhaust gas recirculation cooler comprises a first flange, said first flange and said first housing being directly connected to one another.

18. The exhaust gas recirculation device as claimed in claim 17, wherein the bypass valve comprises a second housing, the exhaust gas recirculation cooler comprises a second flange, said second flange and said second housing being directly connected to one another.

* * * * *

UNITED STATES PATENT AND TRADEMARK OFFICE

CERTIFICATE OF CORRECTION

PATENT NO. : 6,976,480 B2
DATED : December 20, 2005
INVENTOR(S) : Sotsuo Miyoshi and Hidetoshi Okada It is certified that error appears in the above-identified patent and that said Letters Patent is hereby corrected as shown below:

Column 15,
Line 40, delete "3" and insert -- 13 --.

Signed and Sealed this

Twenty-eighth Day of March, 2006

JON W. DUDAS
*Director of the United States Patent and Trademark Office*